US007367377B2

(12) United States Patent
Lin

(10) Patent No.: US 7,367,377 B2
(45) Date of Patent: May 6, 2008

(54) WINDING DEVICE FOR VENETIAN BLIND

(76) Inventor: Ke-Min Lin, 18, Tai San 2 St., Fu Quan Li, Jiayi (TW)

( * ) Notice: Subject to any disclaimer, the term of this patent is extended or adjusted under 35 U.S.C. 154(b) by 123 days.

(21) Appl. No.: 11/339,755

(22) Filed: Jan. 25, 2006

(65) Prior Publication Data

US 2007/0169897 A1 Jul. 26, 2007

(51) Int. Cl.
*E06B 9/322* (2006.01)

(52) U.S. Cl. ..... 160/173 R; 160/171

(58) Field of Classification Search ..... 160/170, 160/171, 168.1 R, 173 R, 178.1 R, 84.01, 160/84.04, 84.05
See application file for complete search history.

(56) References Cited

U.S. PATENT DOCUMENTS 2,250,106 A * 7/1941 Lorentzen ..... 160/170
5,133,399 A * 7/1992 Hiller et al. ..... 160/171
5,228,491 A * 7/1993 Rude et al. ..... 160/171
6,158,494 A * 12/2000 Huang ..... 160/84.05
6,223,802 B1 * 5/2001 Colson ..... 160/84.02
6,918,424 B2 * 7/2005 Lin ..... 160/171
6,945,302 B2 * 9/2005 Nien ..... 160/170
2006/0042763 A1 * 3/2006 Le Ru ..... 160/171
2007/0169898 A1 * 7/2007 Lin ..... 160/171

* cited by examiner

*Primary Examiner*—Blair M. Johnson
(74) *Attorney, Agent, or Firm*—Alan Kamrath; Kamrath & Associates PA

(57) ABSTRACT

A winding device for a Venetian blind includes at least one support seat secured to a headrail to correspond to the position of at least one pull cord and having an inside formed with a through hole and a side formed with a guide hole, and at least one slide bushing mounted on a drive shaft to rotate therewith and pivotally mounted in the through hole of the at least one support seat. Thus, the wound pull cord pushes the slide bushing to move relative to the support seat during rotation of the slide bushing, so that the pull cord is wound around the slide bushing smoothly by movement of the slide bushing so as to lift the pull cord smoothly.

5 Claims, 9 Drawing Sheets

WINDING DEVICE FOR VENETIAN BLIND

BACKGROUND OF THE INVENTION

1. Field of the Invention

The present invention relates to a winding device and, more particularly, to a winding device for a window covering, such as the Venetian blind and the like.

2. Description of the Related Art

A winding device for a Venetian blind is used to wind or unwind two pull cords to lift or lower the two pull cords so as to fold or expand the slats of the Venetian blind. The conventional winding device comprises a threaded rod rotatably screwed into a screw bore so that the two pull cords are wound or unwound by movement of the threaded rod. However, the winding device has an expensive price, thereby increasing costs of fabrication. In addition, it is necessary to screw the threaded rod into the screw bore, thereby wasting the working time and manual work in assembly of the winding device.

SUMMARY OF THE INVENTION

In accordance with the present invention, there is provided a Venetian blind, comprising a headrail, a drive shaft rotatably mounted on the headrail, at least one pull cord movable by rotation of the drive shaft, and a winding device mounted on the headrail and connected to the at least one pull cord to move the at least one pull cord. The winding device includes at least one support seat secured to the headrail to correspond to a position of the at least one pull cord and having an inside formed with a through hole and a side formed with a guide hole located adjacent to the through hole, and at least one slide bushing mounted on the drive shaft to rotate therewith and pivotally mounted in the through hole of the at least one support seat. The at least one pull cord has a distal end extended through the headrail and the guide hole of the at least one support seat and secured to the at least one slide bushing to rotate therewith. The at least one slide bushing is rotatable with the drive shaft to wind the at least one pull cord so that the at least one pull cord is wound around a surface of the at least one slide bushing. When the at least one pull cord is introduced from the guide hole of the at least one support seat, the at least one pull cord is wound around the surface of the at least one slide bushing serially and successively. The wound pull cord pushes the at least one slide bushing to move relative to the at least one support seat during rotation of the at least one slide bushing, so that the at least one pull cord is wound around the surface of the at least one slide bushing smoothly by movement of the at least one slide bushing.

The primary objective of the present invention is to provide a winding device for a window covering, such as the Venetian blind and the like.

Another objective of the present invention is to provide a Venetian blind, wherein the wound pull cord pushes the at least one slide bushing to move relative to the at least one support seat during rotation of the at least one slide bushing, so that the at least one pull cord is wound around the surface of the at least one slide bushing smoothly by movement of the at least one slide bushing to prevent the at least one pull cord from being tangled or overlapped so as to lift the at least one pull cord smoothly.

A further objective of the present invention is to provide a Venetian blind, wherein the at least one support seat and the at least one slide bushing are formed easily, thereby decreasing costs of fabrication of the winding device.

A further objective of the present invention is to provide a Venetian blind, wherein the at least one slide bushing is pivotally mounted in the at least one support seat so that the winding device is assembled easily and rapidly, thereby facilitating production of the winding device.

Further benefits and advantages of the present invention will become apparent after a careful reading of the detailed description with appropriate reference to the accompanying drawings.

DETAILED DESCRIPTION OF THE INVENTION

Figure 1:
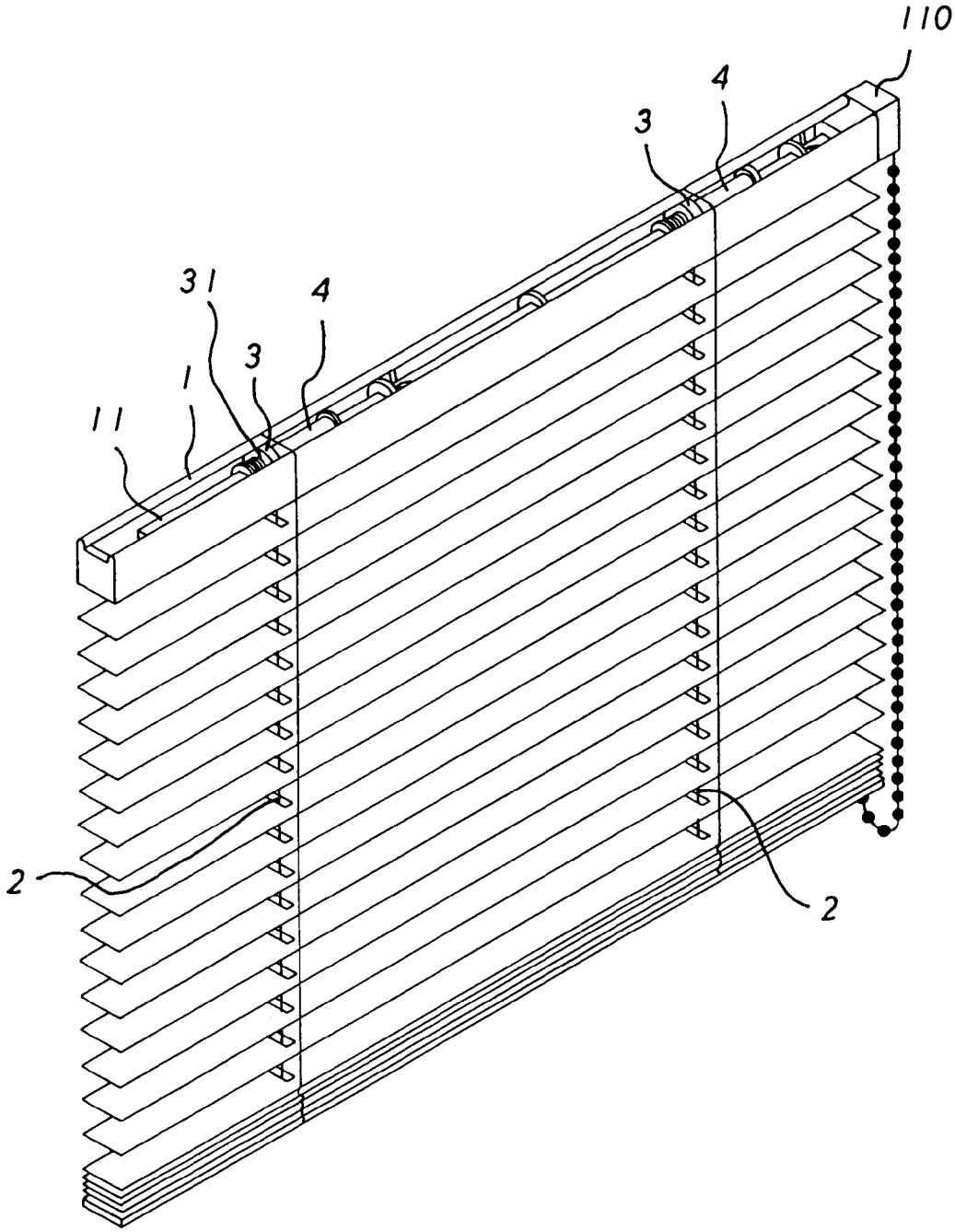
FIG. 1 is a perspective view of a Venetian blind in accordance with the preferred embodiment of the present invention.
Figure 2:
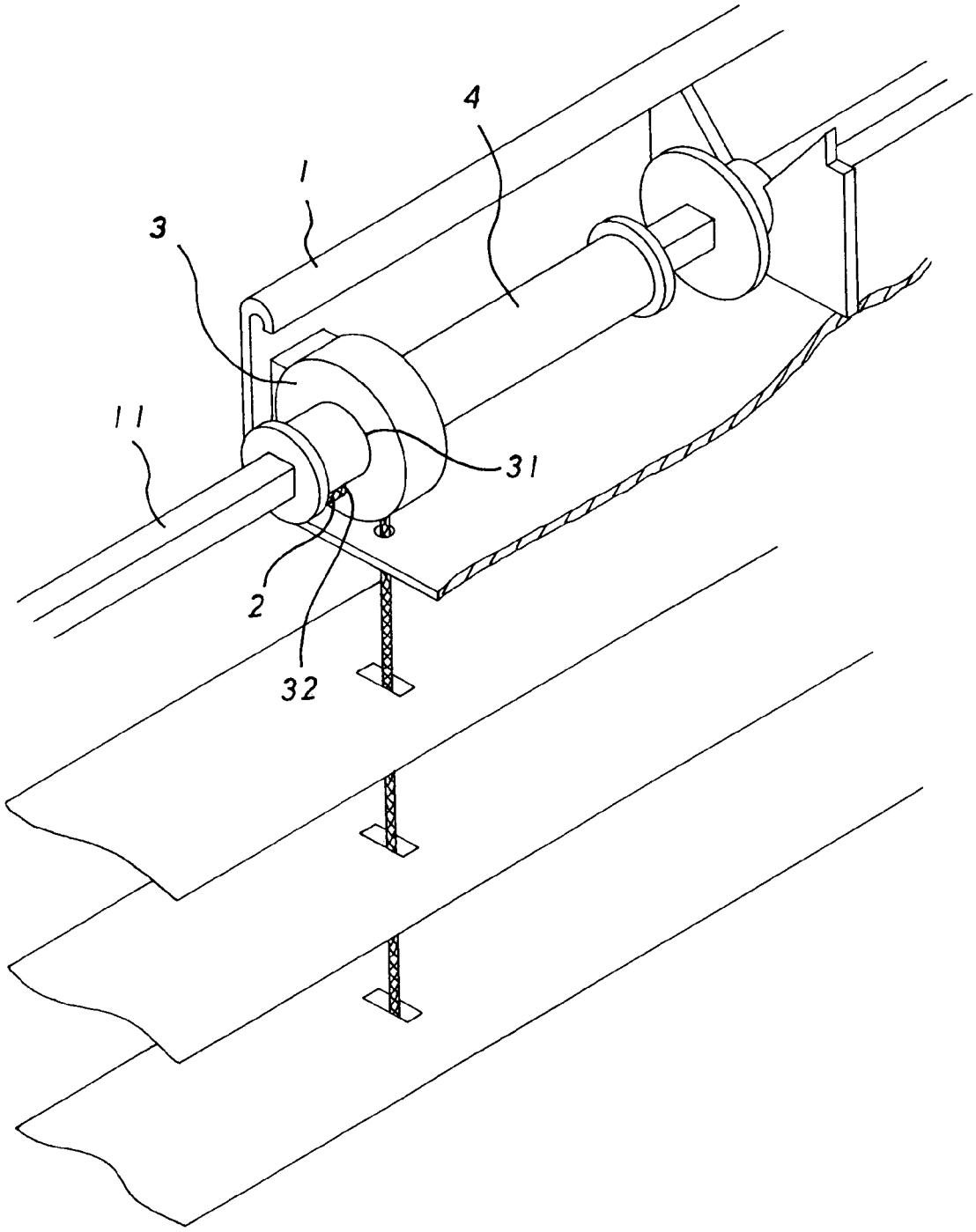
FIG. 2 is a partially perspective cross-sectional view of the Venetian blind as shown in FIG. 1.
Figure 3:
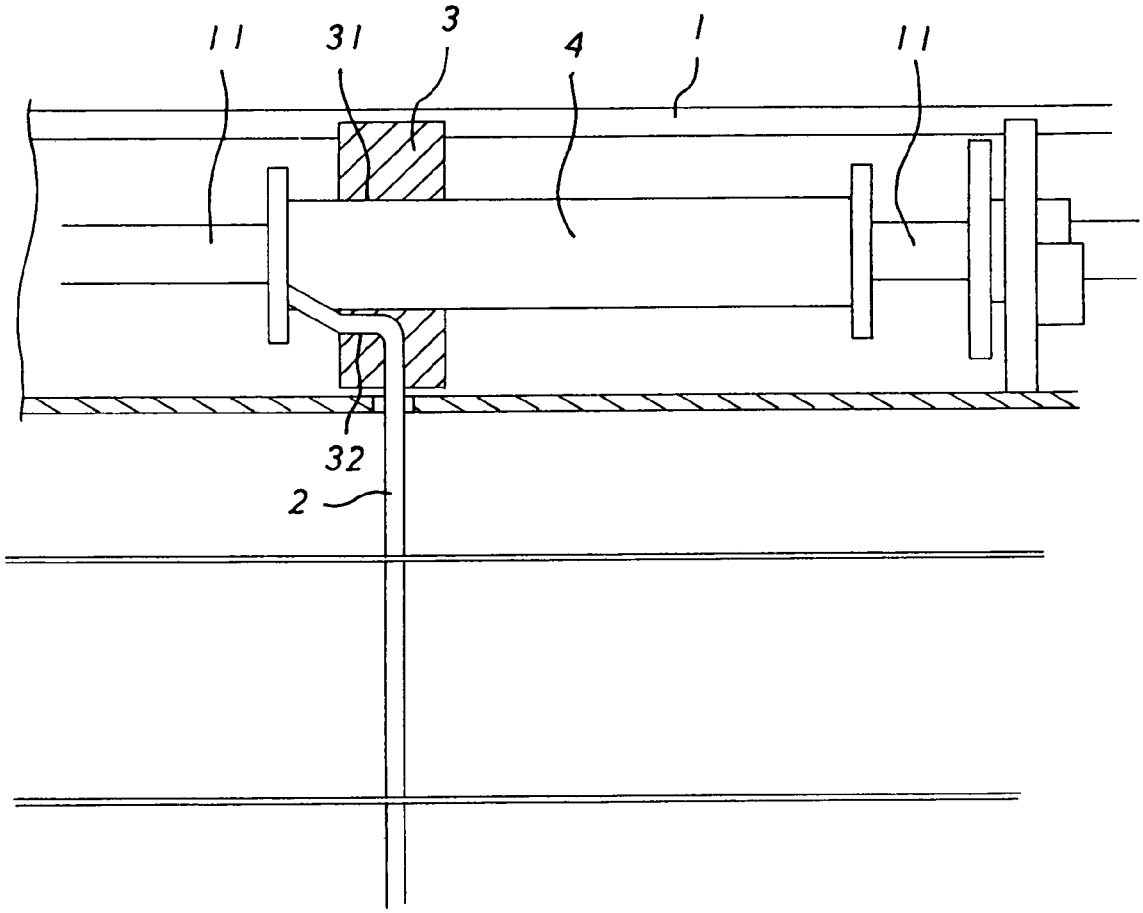
FIG. 3 is a plan cross-sectional view of the Venetian blind as shown in FIG. 2.

Referring to the drawings and initially to FIGS. 1-3, a Venetian blind in accordance with the preferred embodiment of the present invention comprises a headrail 1, a drive shaft 11 rotatably mounted on the headrail 1 and driven by a drive mechanism 110, at least one pull cord 2 movable by rotation of the drive shaft 11, and a winding device mounted on the headrail 1 and connected to the at least one pull cord 2 to move the at least one pull cord 2.

The winding device includes at least one support seat 3 secured to the headrail 1 to correspond to a position of the at least one pull cord 2 and having an inside formed with a through hole 31 and a side formed with a guide hole 32 located adjacent to the through hole 31, and at least one slide bushing 4 mounted on the drive shaft 11 to rotate therewith and pivotally mounted in the through hole 31 of the at least one support seat 3.

The at least one pull cord 2 has a distal end extended through the headrail 1 and the guide hole 32 of the at least one support seat 3, protruded outward from the guide hole 32 of the at least one support seat 3 and secured to the at least one slide bushing 4 to rotate therewith.

Figure 4:
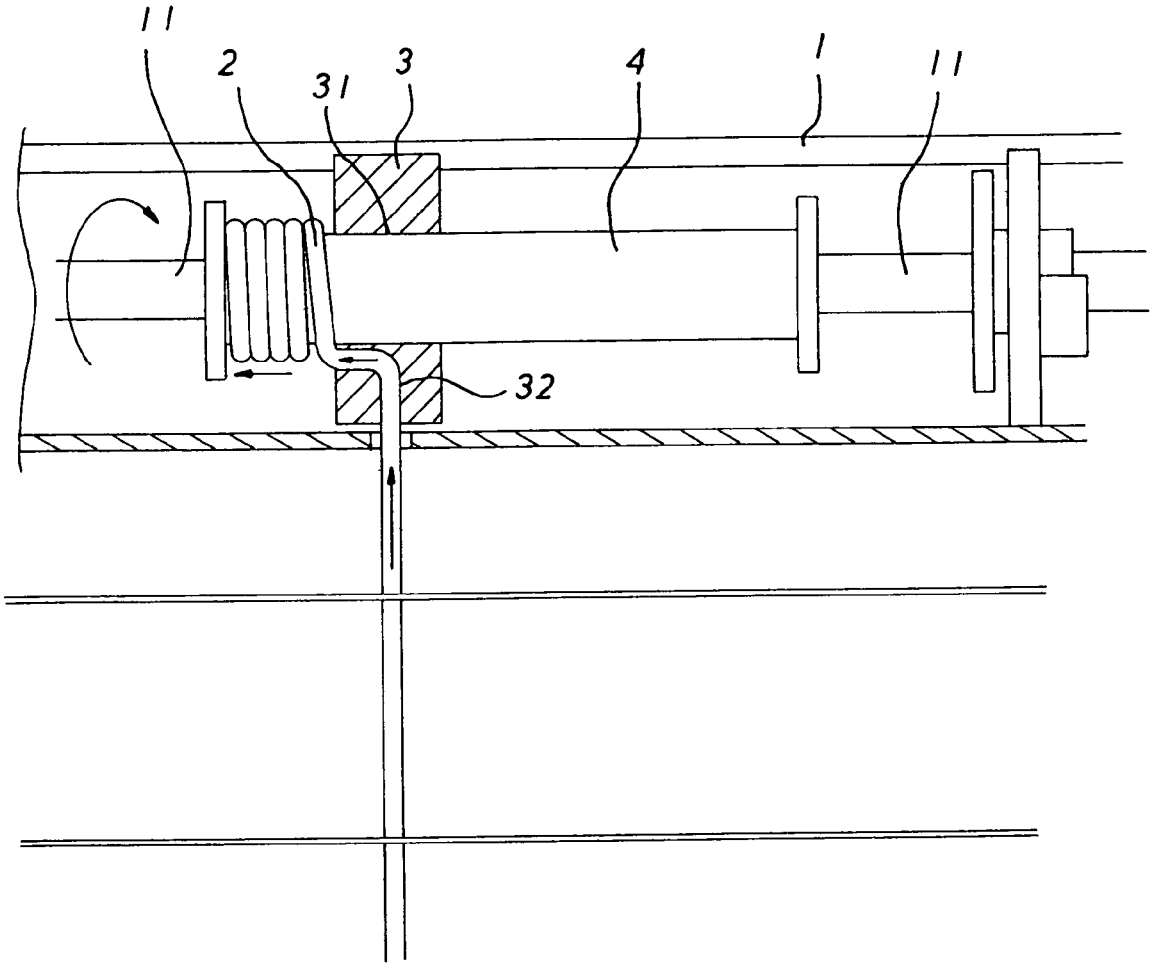
FIG. 4 is a schematic operational view of the Venetian blind as shown in FIG. 3.

In practice, referring to FIGS. 1-4, the at least one slide bushing 4 is rotatable with the drive shaft 11 to wind the at least one pull cord 2 during rotation of the at least one slide bushing 4 so that the at least one pull cord 2 is wound around a surface of the at least one slide bushing 4. At this time, the at least one pull cord 2 is introduced from the guide hole 32 of the at least one support seat 3, and the guide hole 32 of the at least one support seat 3 is located adjacent to the through hole 31, so that when the at least one pull cord 2 is introduced from the guide hole 32 of the at least one support seat 3, the at least one pull cord 2 is wound around the surface of the at least one slide bushing 4 serially and successively as shown in FIG. 4. At the same time, the wound pull cord 2 pushes the at least one slide bushing 4 to move relative to the at least one support seat 3 during rotation of the at least one slide bushing 4, so that the at least one pull cord 2 is wound around the surface of the at least one slide bushing 4 smoothly by movement of the at least one slide bushing 4 so as to lift the at least one pull cord 2 smoothly.

When the at least one pull cord 2 is released, the at least one pull cord 2 is lowered and unwound from the at least one slide bushing 4 by the gravity of the Venetian blind to drive the at least one slide bushing 4 to move reversely relative to the at least one support seat 3 to return to the original position as shown in FIG. 3 so as to lower the at least one pull cord 2 smoothly.

Figure 5:
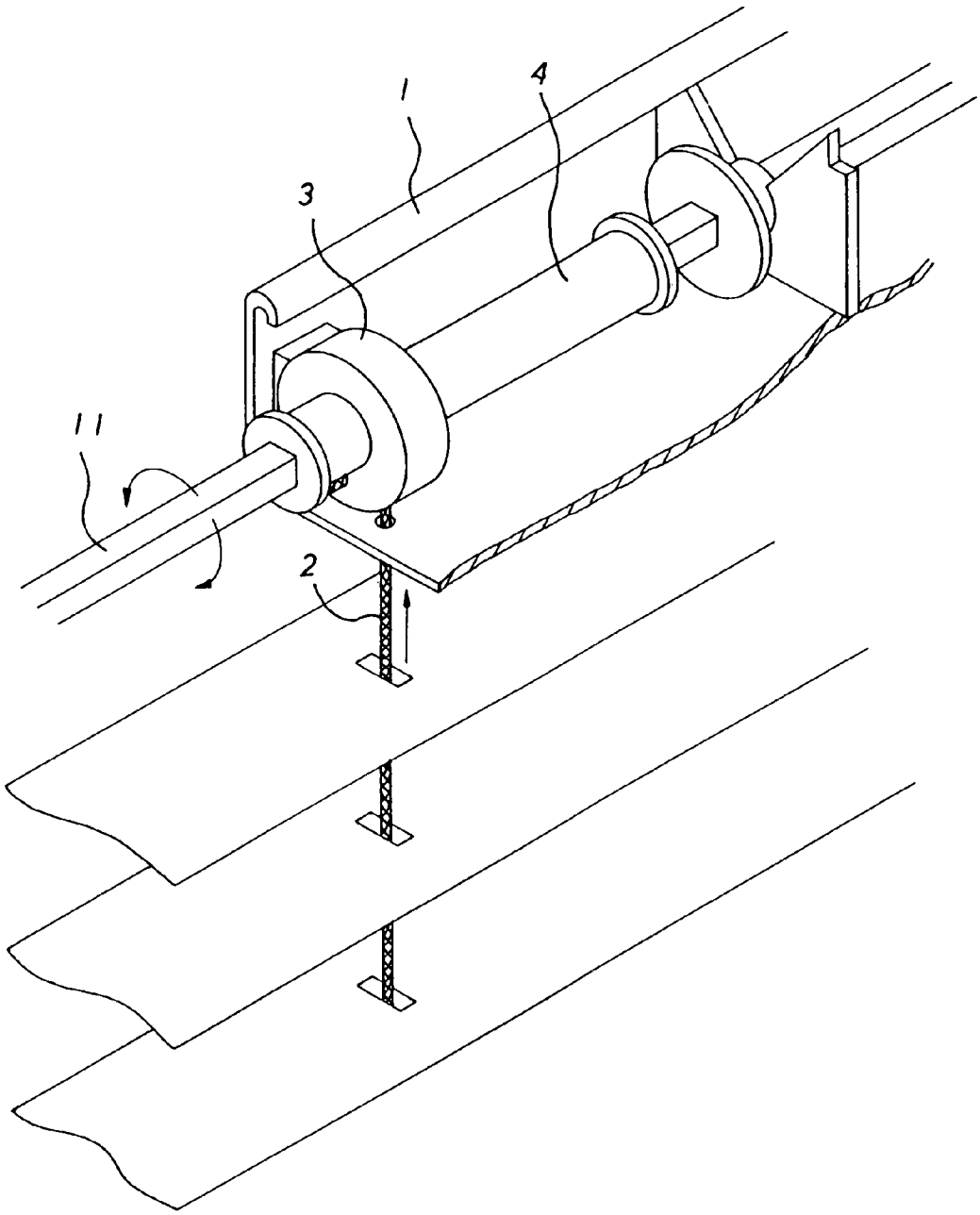
FIG. 5 is a schematic operational view of the Venetian blind as shown in FIG. 2.

As shown in FIGS. 1 and 5, the at least one slide bushing 4 is pivotally mounted in the at least one support seat 3 and is driven by the drive shaft 11 to rotate therewith, so that when the at least one pull cord 2 is unwound and lowered to the lowermost position, the at least one slide bushing 4 is still driven and rotated by the drive shaft 11 to wind the at least one pull cord 2 again without having to change the rotation direction of the drive shaft 11. Thus, the drive shaft 11 is rotated in two directions (the clockwise or counter-clockwise direction) to lift or lower the at least one pull cord 2 in the two directions as shown in FIG. 5, thereby facilitating a user operating the drive mechanism 110 to drive the drive shaft 11 to lift or lower the at least one pull cord 2 so as to fold or expand the Venetian blind.

As shown in FIG. 3, the distance between the through hole 31 and the guide hole 32 of the at least one support seat 3 is smaller than or equal to half of the diameter of the at least one pull cord 2 to prevent the at least one pull cord 2 from being tangled or overlapped.

Figure 6:
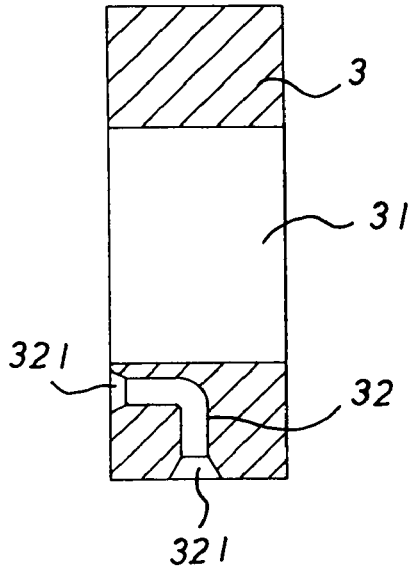
FIG. 6 is a plan cross-sectional view of a support seat of the Venetian blind in accordance with another preferred embodiment of the present invention.

As shown in FIG. 6, the guide hole 32 of the at least one support seat 3 has two ends each formed with a flared opening 321 to facilitate passage and movement of the at least one pull cord 2.

Figure 7:
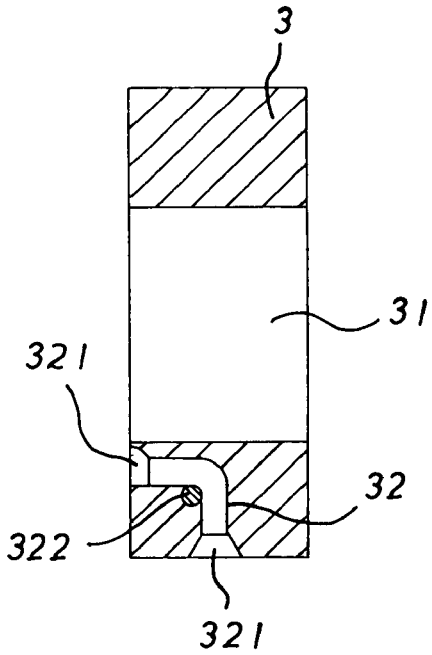
FIG. 7 is a plan cross-sectional view of a support seat of the Venetian blind in accordance with another preferred embodiment of the present invention.

As shown in FIG. 7, the guide hole 32 of the at least one support seat 3 has a bent portion provided with a roller 322 to facilitate movement of the at least one pull cord 2.

Figure 8:
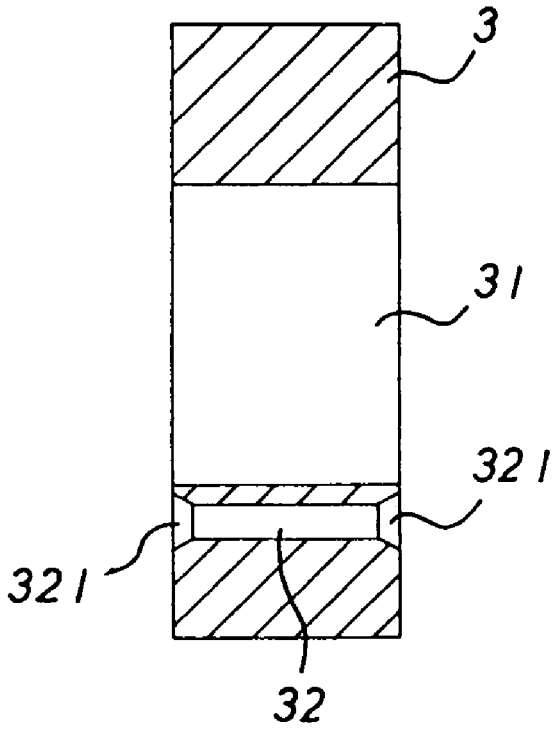
FIG. 8 is a plan cross-sectional view of a support seat of the Venetian blind in accordance with another preferred embodiment of the present invention.

As shown in FIG. 8, the guide hole 32 is extended through the at least one support seat 3.

Figure 9:
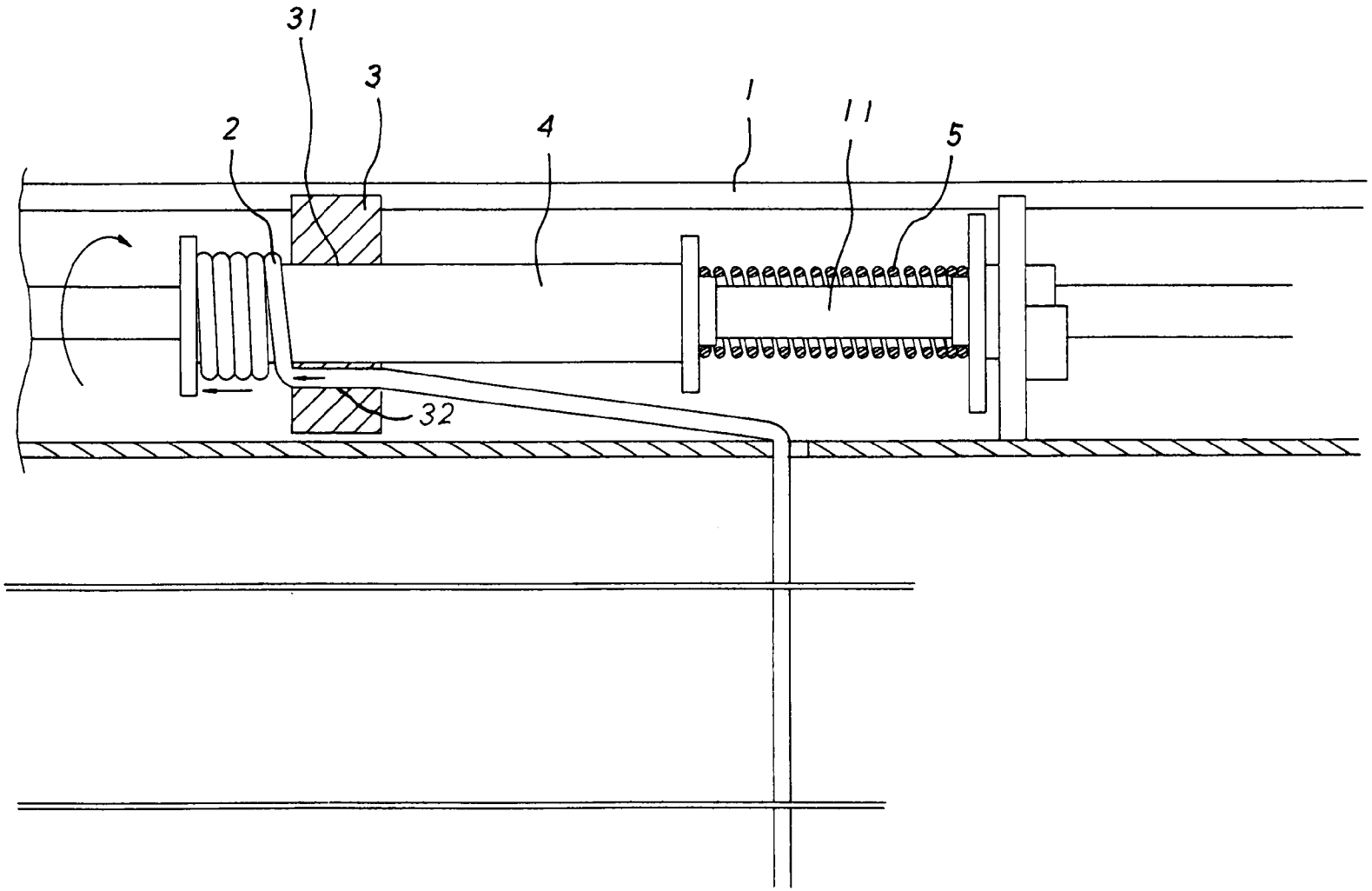
FIG. 9 is a plan cross-sectional view of a Venetian blind in accordance with another preferred embodiment of the present invention.
Figure 10:
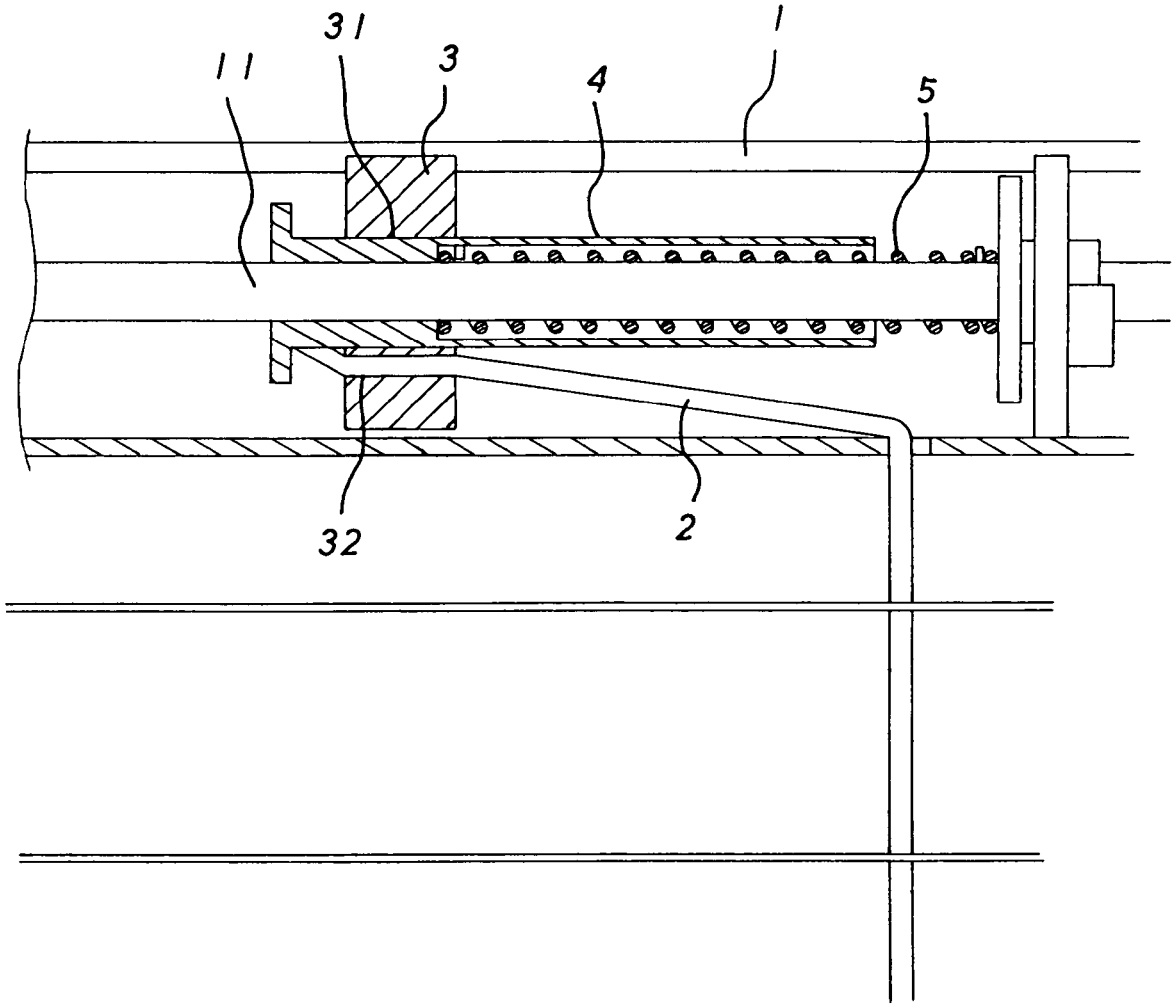
FIG. 10 is a plan cross-sectional view of a Venetian blind in accordance with another preferred embodiment of the present invention.

As shown in FIGS. 9 and 10, the at least one slide bushing 4 is provided with a spring 5 so that when the at least one pull cord 2 is lowered and unwound from the at least one slide bushing 4, the at least one slide bushing 4 is moved smoothly and restored simultaneously by an elastic force of the spring 5. In practice, the spring is a tensile spring provided at an end or in an inside of the at least one slide bushing 4, or a compression spring provided at the other end of the at least one slide bushing 4.

Accordingly, the wound pull cord 2 pushes the at least one slide bushing 4 to move relative to the at least one support seat 3 during rotation of the at least one slide bushing 4, so that the at least one pull cord 2 is wound around the surface of the at least one slide bushing 4 smoothly by movement of the at least one slide bushing 4 to prevent the at least one pull cord 2 from being tangled or overlapped so as to lift the at least one pull cord 2 smoothly. In addition, the at least one support seat 3 and the at least one slide bushing 4 are formed easily, thereby decreasing costs of fabrication of the winding device. Further, the at least one slide bushing 4 is pivotally mounted in the at least one support seat 3 so that the winding device is assembled easily and rapidly, thereby facilitating production of the winding device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A Venetian blind, comprising:

a headrail;

a drive shaft rotatably mounted on the headrail;

at least one pull cord movable by rotation of the drive shaft;

a winding device mounted on the headrail and connected to the at least one pull cord to move the at least one pull cord;

the winding device including at least one support seat secured to the headrail to correspond to a position of the at least one pull cord and having an inside formed with a through hole and a side formed with a guide hole located adjacent to the through bole, and at least one slide bushing mounted on the drive shaft to rotate therewith and pivotally mounted in the through hole of the at least one support seat; wherein:

the at least one pull cord has a distal end extended through the headrail and the guide hole of the at least one support seat and secured to the at least one slide bushing to rotate therewith;

the at least one slide bushing is rotatable with the drive shaft to wind the at least one pull cord so that the at least one pull cord is wound around a surface of the at least one slide bushing;

when the at least one pull cord is introduced from the guide hole of the at least one support seat, the at least one pull cord is wound around the surface of the at least one slide bushing serially and successively;

the wound pull cord pushes the at least one slide bushing to move relative to the at least one support seat during rotation of the at least one slide bushing, so that the at least one pull cord is wound around the surface of the at least one slide bushing smoothly by movement of the at least one slide bushing;

the distance between the through hole and the guide hole of the at least one support seat is smaller than or equal to half of the diameter of the at least one pull cord.

2. The Venetian blind in accordance with claim 1, wherein the at least one slide bushing is provided with a spring so that when the at least one pull cord is lowered and unwound from the at least one slide bushing, the at least one slide bushing is moved smoothly and restored simultaneously by an elastic force of the spring.

3. The Venetian blind in accordance with claim 1, wherein the guide hole of the at least one support seat has two ends each formed with a flared opening.

4. A Venetian blind, comprising:

a headrail;

a drive shaft rotatably mounted on the headrail;

at least one pull cord movable by rotation of the drive shaft;

a winding device mounted on the headrail and connected to the at least one pull cord to move the at least one pull cord;

the winding device including at least one support seat secured to the headrail to correspond to a position of the at least one pull cord and having an inside formed with a through hole and a side formed with a guide hole located adjacent to the through hole, and at least one slide bushing mounted on the drive shaft to rotate therewith and pivotally mounted in the through hole of the at least one support seat; wherein:

the at least one pull cord has a distal end extended through the headrail and the guide hole of the at least one support seat and secured to the at least one slide bushing to rotate therewith;

the at least one slide bushing is rotatable with the drive shaft to wind the at least one pull cord so that the at least one pull cord is wound around a surface of the at least one slide bushing;

when the at least one pull cord is introduced from the guide hole of the at least one support seat, the at least one pull cord is wound around the surface of the at least one slide bushing serially and successively;

the wound pull cord pushes the at least one slide bushing to move relative to the at least one support seat during rotation of the at least one slide bushing, so that the at least one pull cord is wound around the surface of the at least one slide bushing smoothly by movement of the at least one slide bushing;

the guide hole of the at least one support seat has a bent portion provided with a roller.

5. The Venetian blind in accordance with claim 1, wherein the guide hole is extended through the at least one support seat.

* * * * *